United States Patent [19]

Mikula

[11] Patent Number: 4,854,381

[45] Date of Patent: Aug. 8, 1989

[54] HEAT EXCHANGER DEVICE

[76] Inventor: Paul Mikula, 9427 Hyde Park Dr., Twinsburg, Ohio 44087

[21] Appl. No.: 180,335

[22] Filed: Apr. 11, 1988

[51] Int. Cl.[4] ..... F28F 9/02

[52] U.S. Cl. ..... 165/158; 165/901; 165/903; 237/55; 126/307 R

[58] Field of Search ..... 126/307 R, 312, 121, 126/122; 237/52, 55; 165/901, 903, 158

[56] References Cited

U.S. PATENT DOCUMENTS

| | | | |
|---|---|---|---|
| 1,988,642 | 1/1935 | Wolbers | 165/901 |
| 2,811,095 | 10/1957 | Moran | 126/307 R |
| 3,934,798 | 1/1976 | Goldsmith | 165/901 |
| 4,231,516 | 11/1980 | Weingartner | 237/55 |
| 4,232,732 | 11/1980 | Johnson | 237/55 |
| 4,342,359 | 8/1982 | Baker | 237/55 |
| 4,363,353 | 12/1982 | Pranaitis | 237/55 |

*Primary Examiner*—James C. Yeung

*Attorney, Agent, or Firm*—James A. Hudak

[57] ABSTRACT

A unique heat exchanger device which is mounted in the flue of a forced air furnace is disclosed. A plurality of copper tubes are retained in a substantially parallel and equidistant relationship by means of end plates. A plurality of circular metallic fins are positioned on the copper tubes and serve as heat radiating surfaces. Cross tubes are provided within the copper tubes permitting the passage of heated air therethrough. The tube assembly is covered by a perforated shroud permitting air at room temperature to pass therethrough and to circulate among the heated copper tubes. An exhaust manifold is provided on the perforated shroud to permit connection of the device to the cold air return on the furnace.

6 Claims, 2 Drawing Sheets

HEAT EXCHANGER DEVICE

TECHNICAL FIELD

The present invention relates generally to a heat exchanger device and more particularly to a heat exchanger device which utilizes flue gasses from a furnace to heat the air entering the furnace through the cold air return.

BACKGROUND ART

Numerous devices are available for utilizing the flue gasses from a gas or oil fired forced air furnace in order to heat the area surrounding the flue or for heating a contiguous area. Most of these devices utilize some type of baffle arrangement which surrounds the flue in order to heat the air within same or some type of device which is insertable within the flue to heat the heating elements contained therein In addition, most of these devices include a blower apparatus to assist in the circulation of the air within the device and to direct the heated air to the area to be heated Thus, in general, all of these devices are directed to using the heat within the flue gasses for heating the area surrounding the flue or some other contiguous area.

The concept of preheating combustion air in order to conserve heating fuel, whether gas or oil, has been given some attention. The devices that are available, such as that disclosed in U.S. Pat. No. 4,167,212, are permanently mounted within the flue, have a relatively complex construction, and are quite expensive to produce Because of these limitations, these devices have not had wide commercial acceptance In view of the foregoing, it has become desirable to develop a relatively simple, inexpensive heat exchanger device which is mountable within the flue of a gas or oil fired forced air furnace to recover the heat in the flue gasses passing therethrough, and which significantly reduces fuel usage by the furnace.

SUMMARY OF THE INVENTION

The present invention solves the problems associated with the prior art and other problems by providing a unique heat exchanger device which is mounted in the flue of a gas or oil fired forced air furnace. The device is comprised of oppositely disposed end bells, each having a plate across it widest portion. Each plate has a plurality of apertures therein which are aligned permitting their interconnection by means of copper tubes. A plurality of circular metallic fins are positioned on the copper tubes and serve as heat radiating surfaces. The copper tubes also have cross tubes therein permitting the passage of heated air therethrough. The entire copper tube assembly is covered by a shroud which permits air to pass therethrough and circulate among the heated copper tubes. An exhaust manifold is provided on the perforated shroud and is connected to the cold air return on the furnace. In this manner, air at room temperature is heated by the copper tubes and this heated air is used to heat the air which passes through the cold air return to the furnace.

DESCRIPTION OF THE PREFERRED EMBODIMENT

Figure 1:
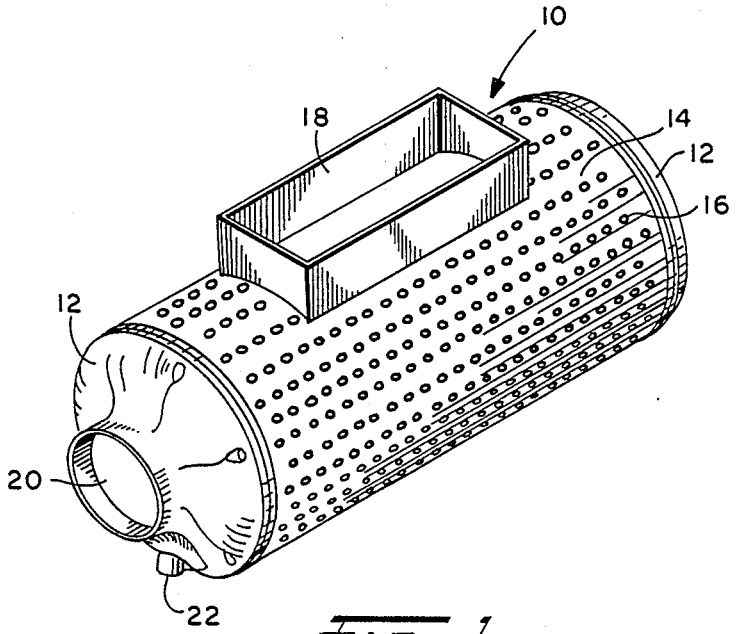
FIG. 1 is a perspective view of the present invention.

Referring now to the drawings where the illustrations are for the purpose of describing the preferred embodiment of the present invention and are not intended to limit the invention hereto, FIG. 1 is a perspective view of a heat exchanger device 10 which can be installed in the flue of a gas or oil fired forced air furnace. As such, the heat exchanger device 10 includes oppositely disposed end bells 12 with a shroud 14 having a tubular configuration interposed therebetween. The end bells 12 are usually formed as aluminum castings and the shroud 14 is usually formed from a light gauge galvanized metal. A plurality of apertures 16 are provided in the shroud 14 and are equally spaced in rows which are substantially parallel to the longitudinal axis of the device 10. A flanged opening 18 is provided in the surface of the shroud 14 to permit the exit of air from the device 10. The flanged opening 18 is generally rectangular in configuration with its longer sides substantially parallel to the longitudinal axis of the device 10. An opening 20 is provided in each end bell 12 to permit insertion of the device 10 into the flue pipe on the furnace and connection thereto. The size of the opening 20 is determined by the size of the flue pipe in which the device 10 is to be installed. A drain hole 22 is provided in each end bell 12 to permit the release of any condensation which might develop in the device 10.

Figure 2:
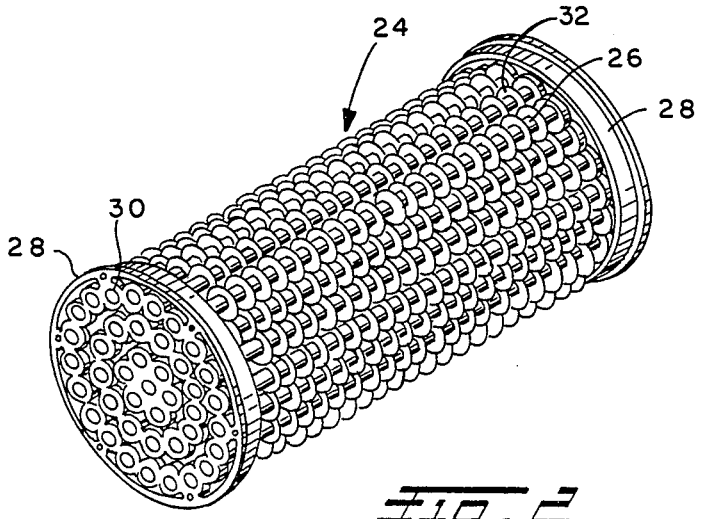
FIG. 2 is a perspective view of the heat exchanger assembly utilized by the present invention.

A perspective view of the heat exchanger assembly 24 utilized by the device 10 is shown in FIG. 2. This heat exchanger assembly 24 is comprised of a plurality of parallel copper tubes 26 and two oppositely disposed aluminum plates 28 having a plurality of substantially evenly spaced apertures 30 therein. The number of apertures 30 in each plate 28 corresponds with the number of copper tubes 26 within in the assembly 24. One of the plates 28 is positioned adjacent one end of the copper tubes 26 and the other plate is positioned adjacent the other end of the copper tubes. The respective ends of the copper tubes 26 are received in the apertures 30 in the adjacent plate 28. By receipt of the ends of the copper tubes 26 in the apertures 30 provided in the oppositely disposed plates 28, the copper tubes are retained in a substantially parallel and equidistant relationship.

Figure 3:
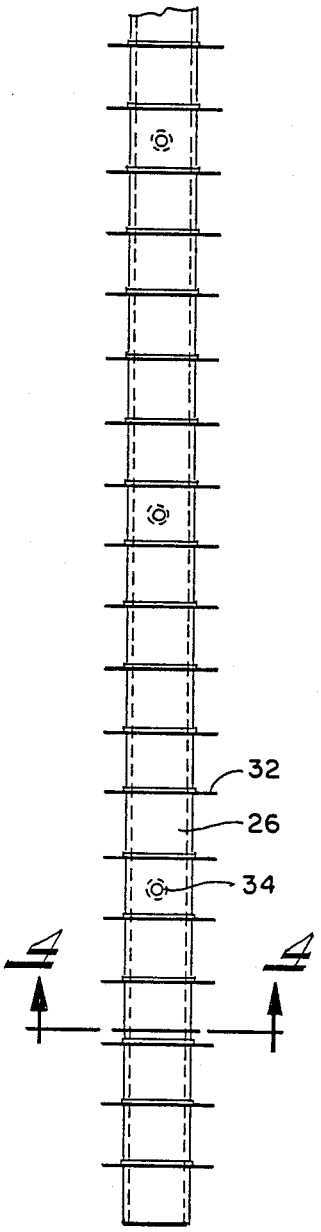
FIG. 3 is a partial front elevation view of one of the copper tubes utilized within the heat exchanger assembly shown in FIG. 2.
Figure 4:
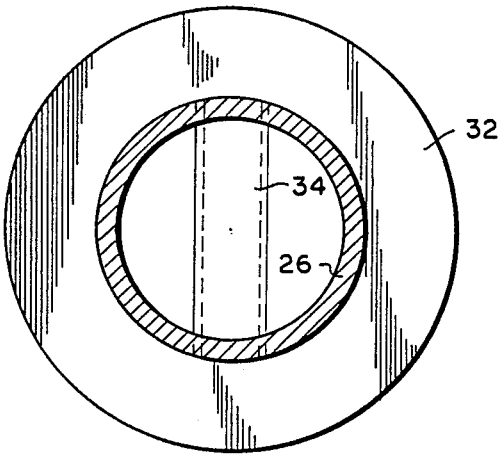
FIG. 4 is an enlarged cross sectional view taken across section indicating lines 4—4 of FIG. 3.

Each of the oppositely disposed plates 28 is attached to its adjacent end bell 12 by fasteners (not shown) which pass through the end bell. In this manner, the end bells 12 are attached to the heat exchanger assembly 24 and the shroud 14 is retained therebetween. Each copper tube 26 may have provided thereon a plurality of aluminum fins 32 each having a substantially circular configuration. The diameter of the fins 32 is such that the periphery thereof does not contact an adjacent copper tube 26. A plurality of cross tubes 34 can be provided in each copper tube 26, as shown in FIGS. 3 and 4, to permit the passage of air transversely through each tube 26.

It has been found experimentally that for optimum operation of the heat exchange device 10, the total inner area of the copper tubes 26 should approximate the area of the flue pipe in which the device is installed. Therefore, in the case of a flue pipe having a five inch diameter, it has been found that the plurality of copper tubes 26 should be comprised of 41 sections of $\frac{3}{4}$ inch copper tubing; each section being approximately 15 inches long. In addition, it has been found that for optimum heat transfer, approximately forty fins 32 should be positioned along each length of copper tubing such that the spacing between each pair of adjacent fins is substantially the same. The thickness of the fins is typically 0.016 inch and the fins have an outer diameter of approximately $1\frac{3}{8}$ inches. Each fin has an inner diameter of approximately $\frac{7}{8}$ inch to provide a relatively tight slip fit on the copper tubing on which it is installed. Each cross tube 34 is formed from $\frac{1}{4}$ inch copper tubing and is retained in the copper tube 26 by flaring the end of the cross tube 34 The cross tubes 34 are located on approximately $2\frac{1}{2}$ inch centers and the cross tubes 34 are positioned within the copper tube 26 such that the openings in the ends of the cross tubes are not blocked by a fin 32 located on the tube 26.

With respect to the installation of the heat exchanger device 10 in a flue pipe having a 6 inch diameter, the same principle applies, viz., the total inner area of the copper tubes 26 should approximate the area of the flue pipe in which the device is installed in order to optimize heat transfer. In this case, it has been found that the plurality of copper tubes 26 should be 31 sections of one inch copper tubing. Here again, the overall length of each section of copper tubing should be approximately 15 inch, and approximately forty fins 32 should be positioned along each length of copper tubing such that the spacing between each pair of adjacent fins is substantially the same. The fins 32 should be formed from 0.016 inch aluminum stock and should have an outer diameter of approximately $1\frac{5}{8}$ inches. The inner diameter of the fins should be approximately $1\frac{1}{8}$ inch permitting slip fit retention on the copper tubes. The cross tubes 34 should be formed from $\frac{1}{4}$ inch copper tubing and the ends of each tube 34 should be flared to provide retention in the copper tube 26 in which it is installed. Here again, the cross tubes 34 are located on approximately $2\frac{1}{2}$ inch centers and the position of the cross tubes 34 is such so that the openings thereto are not obstructed by a fin 32.

The heat exchanger device 10 is installed in a flue of a gas or oil fired forced air furnace by removing a section of the flue having a length which approximates the overall length of the device 10. The flue from the furnace is then connected to one end bell 12 and the other end bell is connected to the exhaust stack of the furnace. The flanged opening 18 in the shroud 14 is connected by a duct to the cold air return on the furnace. Operationally, air surrounding the device 10 enters the device via the apertures 16 in the perforated shroud 14. The copper tubes 26, which have been heated by the flue gasses passing therethrough, heat the entering air. The air after being heated exits from the device 10 via the flanged opening 18 therein and passes to the cold air return on the furnace through the interconnecting duct, thus providing heated air to intermix with and heat the air passing through the cold air return air on the furnace. It has been found experimentally that without use of the device 10, the typical temperature of the air passing through the cold air return to the furnace is approximately 65° F. With the use of the device 10, the temperature of the air exiting from the flanged opening 18 in the device 10 is approximately 120° F. to 145° F. This heated air intermixes with the air passing through the cold air return, heating same to approximately 82° F. to 85° F. Thus, the use of this heat exchanger device 10 results in an increase in temperature of approximately 15° F. to 20° F. in the air which is subsequently used by the furnace. It has been further found experimentally that the utilization of this device 10 results in a savings of approximately 30 to 35 percent in fuel usage by a gas fired forced air furnace. This savings can be directly attributable to the heating of the air passing through the cold air return by this device 10. Thus, utilization of this device results in significant fuel savings. Similar fuel savings can be expected through the use of this device in an oil fired forced air furnace.

Because there are no moving parts within this device 10, and since the device does not require the use of an auxiliary blower apparatus to assist in the circulation of air therethrough, installations using this device are virtually maintenance free. However, if it is desired to inspect or clean the device, the flue pipe from the furnace can be detached from the intake side of the device permitting the end bell 12 on the intake side of the device to be removed allowing the heat exchanger assembly 24 to be inspected and/or cleaned. If a more complete inspection and/or cleaning is desired, the opposite end bell 12 can be detached from the exhaust stack permitting the removal of the device 10 from the flue. Alternatively, by removal of the fasteners from the opposite end bell 12, the heat exchanger assembly 24 and the shroud 14 can be removed for inspection and cleaning purposes.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. A heat exchanger device for use in the flue interconnecting a forced air furnace to an exhaust stack, comprising:

oppositely disposed end members, one of said end members being connectable to the portion of the flue attached to the exhaust stack, the other of said end members being connectable to the portion of the flue connected to the furnace;

a shroud having substantially tubular configuration and having a plurality of perforations positioned in substantially parallel rows around the periphery therof permitting the passage of surrounding air therein, said shroud being interposed between said end members;

a heat exchanger assembly received within said shroud and positioned so as to be substantially parallel to the longitudinal axis of said shroud and interposed between said ends members, said heat exchanger assembly allowing the passage of flue gasses therethrough from the furnace to the exhaust stack causing an increase in the temperature of said heat exchanger assembly resulting in the heating of said surrounding air passing into said shroud; and outlet means attached to said shroud connecting to the cold air return portion of the furnace permitting said heated air to pass through said heat exchanger device to the furnace.

2. The heat exchanger device as defined in claim 1 wherein said heat exchanger assembly is comprised of a plurality of tubes and oppositely disposed plates having a plurality of apertures therein to receive the ends of said tubes.

3. The heat exchanger device ad defined in claim 2 wherein said apertures in each of said oppositely disposed plates are positioned so that said tubes after insertion in said apertures are substantially equidistant from one another and in an aligned relationship with one another.

4. The heat exchanger device as defined in claim 2 wherein the longitudinal axes of said tubes are substantially parallel to one another and to longitudinal axis of said shroud.

5. The heat exchanger device as defined in claim 2 further including at least one heat radiating member attached to the surface of each of said plurality of tubes, said heat radiating members being in an interleaved relationship with one another on adjacent tubes.

6. The heat exchanger device as defined in claim 2 further including at least one cross tube received within at least one of said plurality of tubes, the axis of said at least one cross tube being substantially perpendicular to the axis of said at least one of said plurality of tubes permitting the passage of air both longitudinally and transversely through at least one of said plurality of tubes.

* * * * *